US005388666A

United States Patent [19]

Schwörer

[11] Patent Number: 5,388,666

[45] Date of Patent: Feb. 14, 1995

[54] SUPPORT SCAFFOLD

[75] Inventor: Artur Schwörer, Baden-Württemberg, Germany

[73] Assignee: Peri GmbH, Weissenhorn, Germany

[21] Appl. No.: 2,791

[22] Filed: Jan. 11, 1993

[30] Foreign Application Priority Data

Jan. 25, 1992 [DE] Germany ..... 4201958

[51] Int. Cl.[6] ..... E04G 1/12

[52] U.S. Cl. ..... 182/179; 182/178

[58] Field of Search ..... 182/179, 178; 52/637, 52/638

[56] References Cited

U.S. PATENT DOCUMENTS

| | | | |
|---|---|---|---|
| 3,313,081 | 4/1967 | Squire | 52/645 |
| 4,069,638 | 1/1978 | Hasslquist et al. | 52/726.2 |
| 4,462,197 | 7/1984 | D'Alesio et al. | 182/179 X |
| 5,031,724 | 7/1991 | Quinn | 182/178 X |

FOREIGN PATENT DOCUMENTS

| | | | |
|---|---|---|---|
| 049096 | 4/1982 | European Pat. Off. | 182/178 |
| 0252748 | 1/1988 | European Pat. Off. | E04G 7/26 |
| 0445014 | 9/1991 | European Pat. Off. | F16B 2/10 |
| 2144255 | 2/1973 | France | E04G 5/00 |
| 2147430 | 3/1973 | France | E04G 1/00 |
| 2634465 | 7/1976 | Germany | E04G 1/14 |
| 291046 | 3/1979 | Germany | E04G 1/18 |
| 3641349 | 6/1988 | Germany | E04G 1/12 |
| 2083535 | 3/1982 | United Kingdom | E04G 1/12 |
| 2234005 | 1/1991 | United Kingdom | 182/179 |

*Primary Examiner*—Alvin C. Chin-Shue

*Attorney, Agent, or Firm*—Fields, Lewis, Rost & Smith

[57] ABSTRACT

The invention concerns a support scaffold with adjustable-height posts having an outer tube (2) and an inner tube (1), and with stiffeners (8) and fastening means (11) arranged between them for the attachment between outer tube (2) and stiffener. The invention consists in the fact that the stiffener (8) can be fastened both to the outer tube (2) and to the inner tube (1). As a result, the stiffener can be arranged at any desired height on an extended post, thus producing very high load-bearing capacity for the scaffold.

14 Claims, 3 Drawing Sheets

SUPPORT SCAFFOLD

The invention relates to a support scaffold with adjustable-height posts having an outer tube and an inner tube, and with stiffeners and fastening means arranged between them for the attachment between outer tube and stiffener.

Known scaffolds of this type for supporting ceiling loads have been disclosed by the "Titan" brochure of the Ischebeck company.

In these scaffolds, however, fastening means for attachment to the stiffener are arranged only on the outer tube, whereas stiffeners cannot be attached to the inner tube.

Posts are nevertheless known in which the inner tube is approximately of the length of the outer tube, so that when the inner tube is extended to its maximum extent, a relatively long post segment consists exclusively of the inner tube. With an outer tube length of, for example, 1.90 m, the result, with a DIN-prescribed overlap of 30 cm when fully extended, is a ceiling post with a maximum length of 3.50 m. In the aforesaid known scaffolds, in which the stiffeners can be fastened only to the outer tube, posts are used in which, because of the reduction in load-bearing capacity, only a relatively short threaded spindle with a foot or ceiling plate is arranged in the outer tube, so that the total length of the post is not very much greater than the length of the outer tube.

The underlying object of the invention is to develop a scaffold which can support even heights that are considerably greater than the length of the outer tube, i.e. which can support heights that are up to twice the height of the outer tube minus the prescribed overlap between the inner and outer tube of an adjustable-height post.

According to the invention, this object is achieved by the fact that the stiffener can be fastened both to the outer tube and to the inner tube. The stiffener can consist of frames in a manner known in the art, but also only of bars extending transversely.

One advantage of the invention consists, firstly, in the fact that the stiffeners can be arranged at any height on the extended post, and thus that very high loads can be supported, for example not only the loads of a ceiling, but also loads on other support scaffolds such as for example with arches, bridges, or the like. The stiffeners can thus be applied at points on the scaffold which are particularly favorable in terms of statics.

In one embodiment of the invention, the stiffener can have both connecting parts for connection of the inner tube and connecting parts for connection of the outer tube, which can be configured differently. The advantage of this embodiment is that a large number of design possibilities exist for fastening the stiffeners both to the outer tube and to the inner tube. This embodiment is, for example, also suitable if the inner tube has outer threads over its entire length or in any case over a large portion of its length. Specifically, the fastening parts intended for fastening to the inner tube can then be configured to engage in the threads, but the parts for fastening the stiffener to the outer tube are configured much more simply if, for example, mere notches or projections are provided on the outer tube of the post for fastening the stiffener.

In another embodiment of the invention, both the connecting parts of the stiffener for fastening to the inner tube and the connecting parts for fastening the stiffener to the outer tube configured identically, for example can also be adjustable. This embodiment of the invention can be further developed in that at a defined point on the stiffener, only one connecting part, configured both for fastening to the inner tube and for fastening to the outer tube, is provided. This allows very simple handling when erecting such scaffolds.

The invention is suitable not only for posts in which the inner tube can be extended telescopically, but also for use in conjunction with posts known in the art in which the inner tube has, over a long segment of its length, threads that are used to adjust the height of the post. The invention can also be implemented in conjunction with posts in which the inner tube is round, and the threads are cut over the entire circumference of the inner tube.

In embodiments of the invention, the cross section of the inner tube of the post is not circular, and the threads are arranged only in the regions with a large outside diameter. The advantage of this embodiment of the invention is that in the circumferential segments that have a smaller diameter and therefore have no threads, special retainers for the connecting parts of the stiffener can be provided, which therefore do not interfere with the usual threaded nut for bracing the inner tube on the outer tube, or vice versa.

In this context the cross section of the outer tube can be circular or, in a particular embodiment of the invention, can have a cross section whose shape corresponds to the shape of the cross section of the inner tube, but is larger than it in order to accommodate the inner tube.

In a development of this embodiment, the outer tube and the inner tube have radially projecting lobes, which have projections running perpendicular to the radius and, on the radially inward side of these projections, recesses for the entry of fastening means, engaging behind the projections, that are arranged on the stiffeners. The advantage of this configuration of the cross section of the outer and inner tubes is that only a single kind of fastening means needs to be arranged on the stiffener, for example a kind of clamp, which is configured so that it can engage behind both the projections on the outer tube and the projections on the inner tube.

In one embodiment of the invention, the connecting parts of the stiffener engage on the post outside the plane defined by the axes of two adjacent posts, in other words, for example, eccentrically to the side of the post axis. An arrangement of this kind has been disclosed by the "Ischebeck Titan" brochure, but there a stiffener bar engages only on the outer tube. In the known arrangement, the end of the stiffener bar has an eye running perpendicular to the axis, into which a screw is fastened, the head of which is held in a groove that is T-shaped in cross section. This manner of fastening laterally to the post in embodiments of scaffolds according to the invention has the advantage that the length of the stiffeners and the arrangement of the connecting parts for fastening the stiffener to the post can be arranged exactly at the same point on the stiffener, since the axial dimension between the fastening points of the stiffener is identical on adjacent posts. The stiffener can therefore be fastened to the outer tube or inner tube with one and the same connecting part, provided only that the parts working together with these connecting parts correspond on the outer tube and inner tube.

The receptacles provided on the outer tube and inner tube for the fastening means provided on the stiffeners can be arranged at intervals from one another along the tubes. In another embodiment, the lobes and the projections of the tubes are formed by the shape of the tube cross section, and extend over the entire length of the tube. This has not only the advantage that such tubes can be manufactured by the extrusion method and therefore that manufacture of the posts is particularly simple, but also the additional advantage that the stiffener can be arranged at any height on the adjustable-height post, resulting in a scaffold of extraordinarily high load-bearing capacity whose load-bearing capacity, when the stiffener is configured suitably—for example in the form of a frame—can be several times the load-bearing capacity of an individual post. To produce the support scaffold, the individual posts can then be erected with several, for example three, above one another.

In the aforesaid embodiment of the invention, the outer threads of the inner tube can be arranged in the region of the circumferential surface of the lobes, so that height adjustment of the ceiling posts can occur in the usual manner by means of screw threads with a threaded nut braced against the outer tube. Of course the height adjustability of the ceiling post can also be ensured in a manner known in the art by means of bolts that can be inserted through recesses in the outer tube and inner tube.

The posts can be manufactured from steel or also from aluminum. The threads can be cut or rolled into portions of the circumference, or can be rolled in as the tube is being manufactured, for example using the extrusion method.

The invention also concerns a post in which one or more of the aforesaid features is implemented, and that is not part of a support scaffold.

Further features of the invention are evident from the following description of an embodiment of the invention, in conjunction with the claims and the drawings. The individual features can be implemented each individually or multiply in embodiments of the invention.

The drawings depict embodiments of the post according to the invention, in conjunction with a plurality of embodiments of fastening parts arranged on a stiffener.

Figure 1:
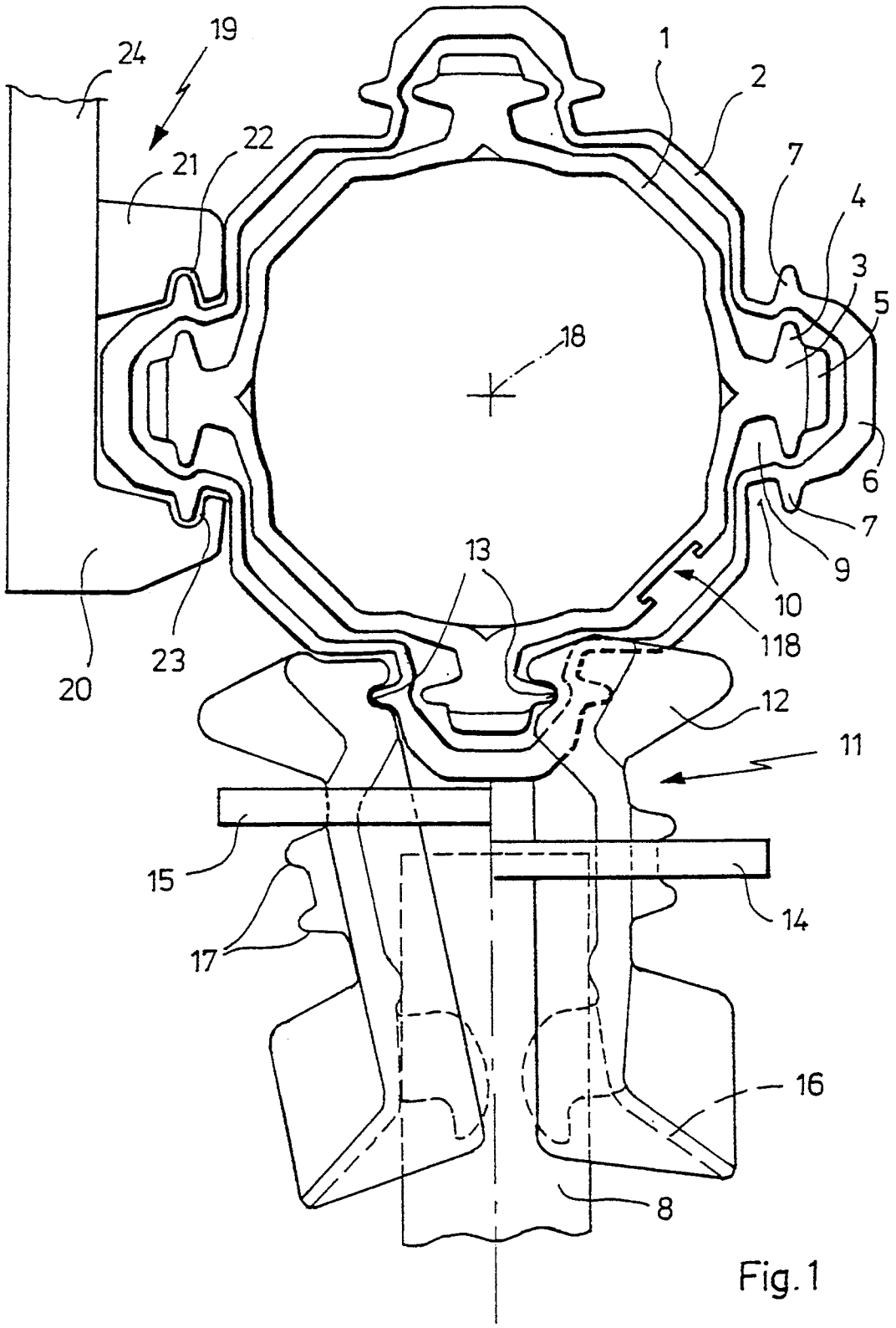
FIG. 1 shows a top view of a post according to the invention, with two embodiments of the fastening parts.

In the embodiment of the invention depicted in FIG. 1, an inner tube 1 of an extensible post for a ceiling scaffold has approximately the same cross-sectional shape as an outer tube 2 that completely accommodates the inner tube 1. The inner tube 1 has four radially spaced lobes 3 distributed over the circumference, which have projections 4 running transverse to the radius and have threads 5 on their outer surface. The inner tube 1 is manufactured by extrusion. The lobes 3 and the projections 4 run along the circumference of the inner tube 1 in the direction of the surface lines over the entire length of the inner tube 1. Between the outer surface of the inner tube 1 and the inner surface of the outer tube 2 there is sufficient clearance so that the inner tube 1 can easily be displaced lengthwise in the outer tube 2. Into the threads 5 engages a threaded nut (not depicted), which is configured as a wing nut and which, when the inner tube 1 is extended, is screwed along the axial direction of the inner tube 1 until said nut is in contact with the end surface of the outer tube 2, thus determining the extended length and transferring the load carried by the inner tube 1 to the outer tube 2. As depicted in the drawing, the threads 5 have a diameter that is greater than the smallest diameter of the outer tube 2, so that one rotation of the threaded nut produces a relatively large displacement of the post in the axial direction. Since the threads 5 are arranged only on a portion of the circumference, they are considerably easier to manufacture than in the case of spindles with threads running around the entire circumference. In the embodiment depicted, the other walls of the inner tube 1 do not have the shape of circular arc segments, but rather have a shape reminiscent of an octagon, which at least partially fulfills the static requirements and also the requirements for simple manufacture.

The cross section of the outer tube 2 has, at least on its inner surface, a shape that matches the shape of the outer surface of the inner tube 1. The outer tube 2 also has lobes 6 extending over the entire length, which again have projections 7 running perpendicular thereto. The wall segment located between the lobes 6 also recalls the shape of an octagon. The wall thickness of tubes 1 and 2 is selected so that the two have approximately the same stability, and high scaffolds can be produced with no reduction in load even with individual posts extended, for example even without a stiffener 8 between individual posts. Located on the side of the projections 4 and 7 that faces the tube wall are recesses 9 and 10 which allow the entry of the fastening means, engaging behind the projections 7 and 4, which are arranged on the stiffener 8 and act to fasten said stiffener 8 to the inner tube 1 or outer tube 2.

The inner tube 1 also has a recess 18 running lengthwise, in which, for example, a scale can be fastened. The cross section of the recess 18 can be T-shaped.

Fastening means provided on the stiffener 8 can be variously configured in conjunction with the embodiment of the post as depicted. The drawings depict an embodiment that is configured in the manner of a clamp. This clamp has two clamping jaws 12 opposing one another, which have on their sides facing each other recesses 13 that can engage around both the lobe 7 of the outer tube 2 (left side of the depiction) and the lobe 4 of the inner tube 1 (right side of the drawing); the front part of the clamping jaws 12, adjacent to the recess 13, then enters the recess 9 or 10 and thereby engages behind the lobe 4 or 7, thus guaranteeing a positive attachment between the stiffener 8 and the post tube 1 or 2 to handle tensile or compressive forces.

The tightly clamped position in which the clamp grasps the lobes 3 of the inner tube 1 is secured by a wedging shackle 14 (not depicted in detail), while the somewhat wider clamped position required to engage around the lobes 6 of the outer tube 2 is secured by the same wedging shackle at a different wedging stage. The fastening means 11 is fastened onto the stiffener 8, which can be a frame or also simply a crossbar. A stop 16 for the open position of the clamp, and a guide for the wedging shackle 14, formed from two knuckles 17, can also be provided on the clamp acting as the fastening means 11.

The clamp 11 connects the stiffener 8 to the post in the plane defined by the axes 18 of two adjacent posts.

It is also possible, however to fasten stiffeners to the posts outside this plane, for example eccentrically with respect to the post axis 18, in other words so that compressive and tensile forces act on a post somewhat tangentially. The principle of this is depicted in FIG. 1 by means of a connecting part 19, configured in the manner of a screw clamp, with one stationary clamping jaw 20 and one displaceable clamping jaw 21. The two clamping jaws have, on the inner surfaces which face one another, recesses 22 and 23 that are suitable both for receiving the lobes 7 on the outer tube and for receiving the lobes 4 on the inner tube. To fasten a stiffener 24 to the outer tube of the post, the jaw opening of the screw clamp after clamping of the clamping jaw 21 is simply somewhat greater than when the stiffener 24 is fastened to the corresponding connecting parts 4 of the inner tube.

Figure 2:
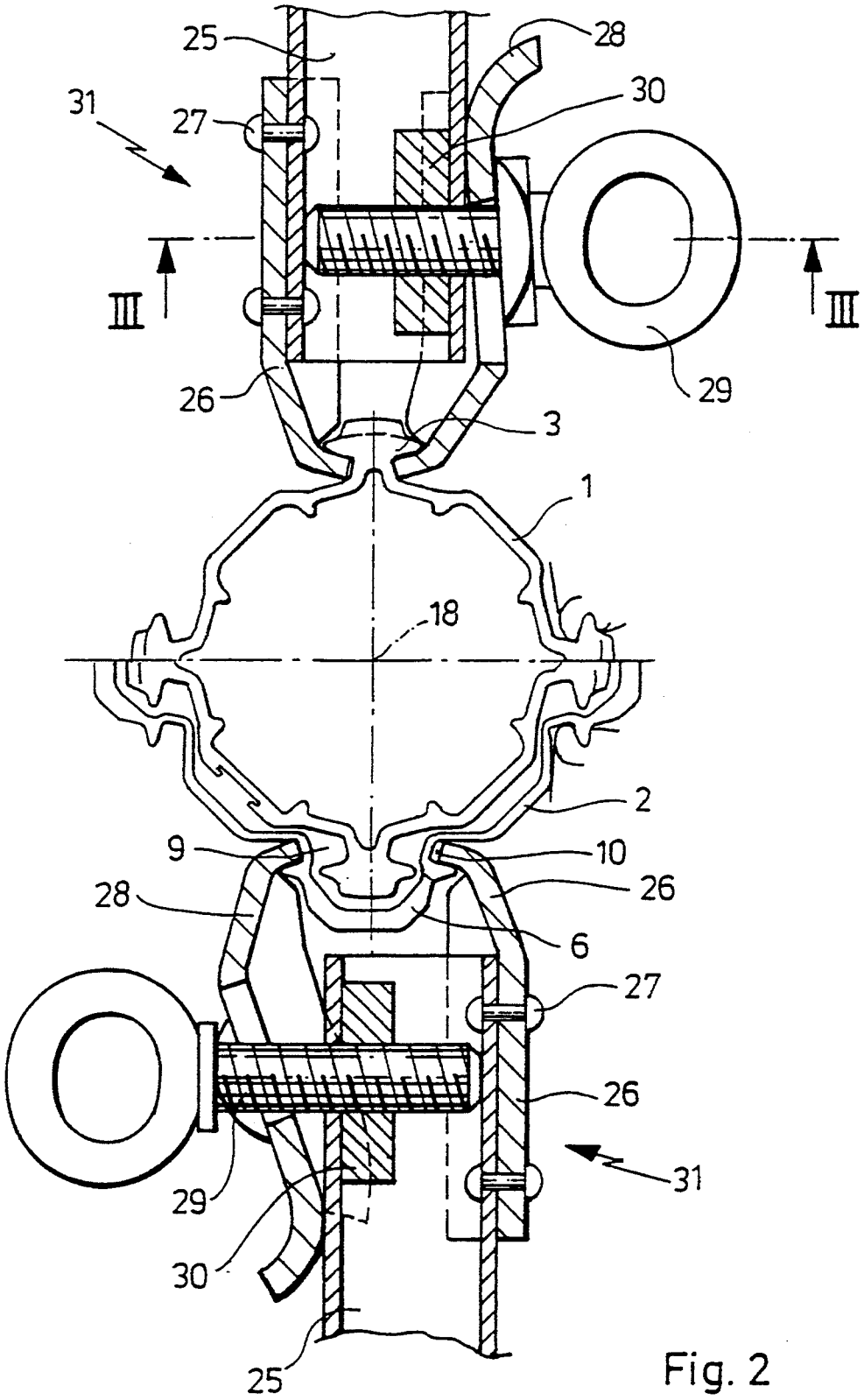
FIG. 2 shows the post cross section depicted in FIG. 1, in conjunction with other connecting parts of a stiffener, at reduced scale.
Figure 3:
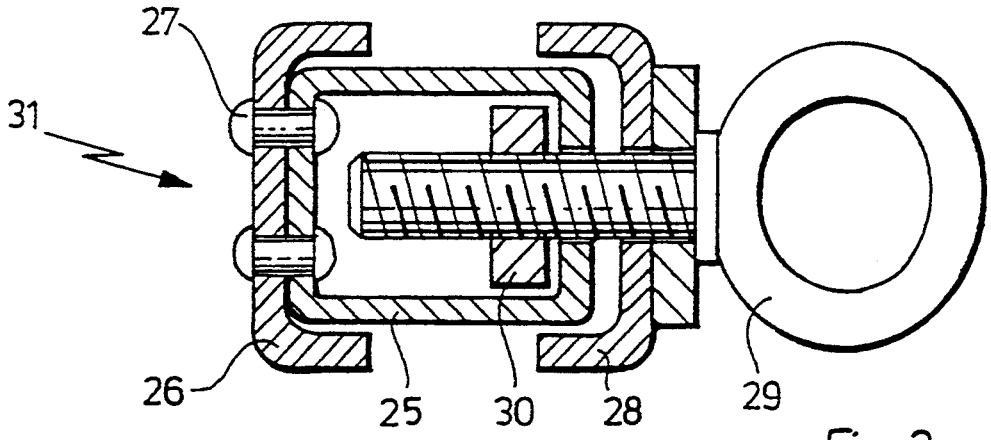
FIG. 3 shows a section along line III in FIG. 2.

In the embodiment of the invention depicted in FIG. 2, a stiffener 25 is once again fastened in the plane formed by the axes 18 of adjacent posts. In FIG. 2, only the parts necessary for an understanding of the invention are depicted in principle. At the end of a bar of the stiffener 25, one clamping jaw 26 of a fastening clamp is permanently fastened by rivets 27, the end of said clamp engaging, in the lower part of FIG. 2, into the recess 10 on the lobe 6 of the outer tube 2. Located opposite the clamping jaw 26 is a movable clamping jaw 28 that can be pressed by means of a screw 29 into the recess on the lobe 6 opposite the recess 10. The screw 10 is guided in a threaded manner in a threaded element 30. The jaw opening of the clamp is adjusted, by rotating the screw 29, depending on whether the stiffener 25 is to be fastened on the outer tube 2 into the recesses 10, or into the recesses 9 of the inner tube. Fastening of the stiffener 25 by means of the clamp 31 onto a lobe 3 of the inner tube is indicated at the top of FIG. 2.

It is evident that because of the rigid fastening of the clamping jaw 26 onto the tube of the stiffener 25, the axis of this tube runs, when fastened onto the outer tube of the post, at a short distance from the plane defined by the axes 18 of adjacent posts. When fastened onto the inner tube 1, on the other hand, the axis of the tube of the stiffener 25 runs precisely in the plane defined by the axes 18.

Figure 4:
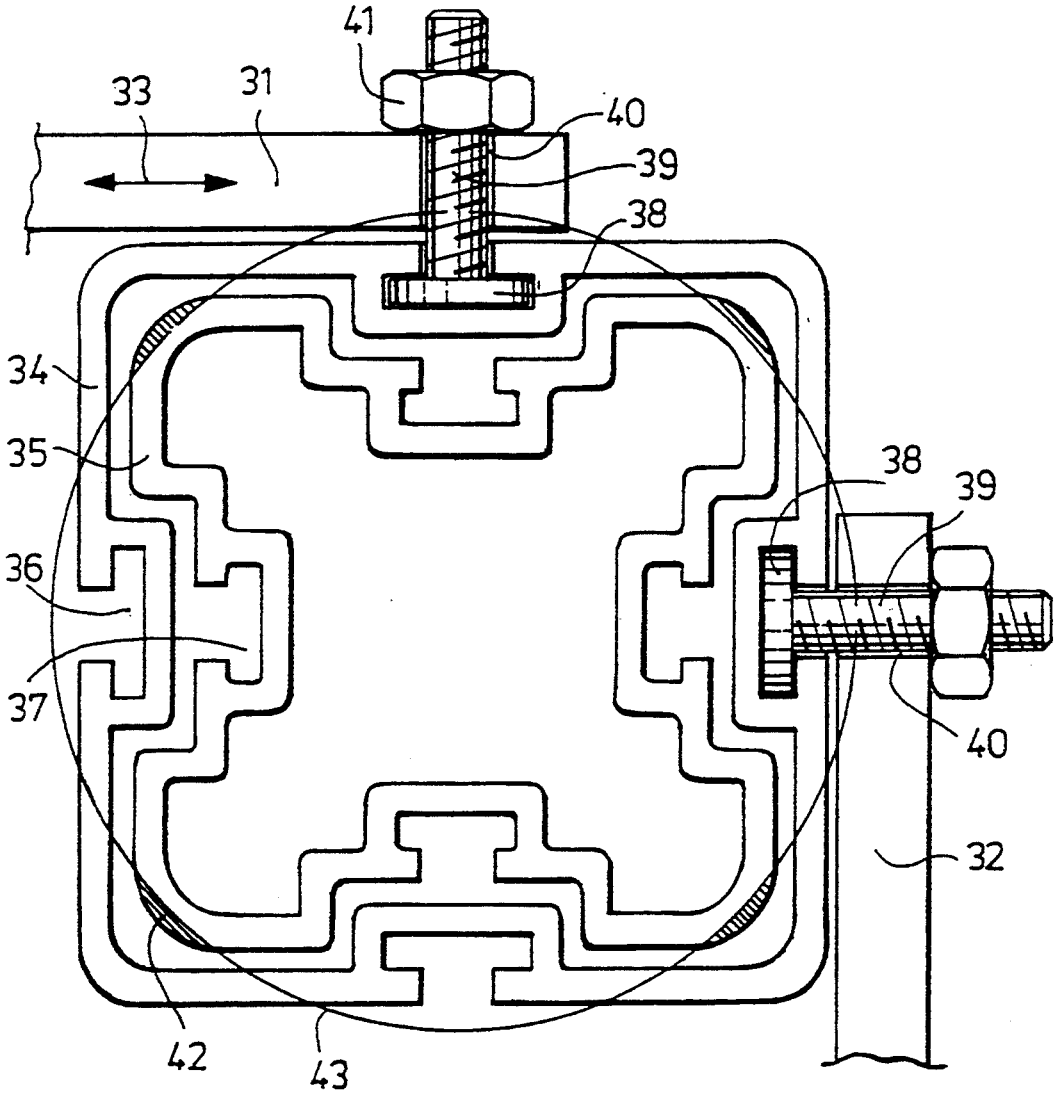
FIG. 4 shows a top view, corresponding to FIG. 1, of another cross section of the post tubes and other connecting parts of the stiffener.

FIG. 4 shows another fastening means between the tubes of the post and stiffeners 31 and 32. Compressive and tensile forces act in these stiffeners, as indicated by the double arrow 33. The outer tube 34 and inner tube 35 have an approximately square cross section. The two tubes have on their sides, offset 90° from each other, lengthwise grooves 36 on the outer tube and 37 on the inner tube, each T-shaped in cross section, into which a screw head 38 shaped like a hammer head can be introduced. The associated screw shank 39 passes through an eye 40 at the end of the stiffeners 31 and 32, and is fastened there by means of a nut 41. These fastening means can engage, without modification, both on the outer tube 34 and on the inner tube 35. The forces exerted by the stiffeners 32 and 33 once again act tangentially on the post.

The inner tube 35 has, on its segments which have the largest outside radius, threaded segments 42 into which engage, when the inner tube is extended, the internal threads 43 of a wing nut that acts to adjust the post height and is braced against the end surface of the outer tube 34. The wing nut is not drawn; only the circle of the internal threads 43 is shown.

In the embodiment of the invention shown in FIG. 4, the stiffeners 31 and 32 are arranged at right angles to one another on the post 34, 35. This possibility represents a further advantage of the embodiments according to the invention.

Notches (not depicted in the drawings) can be impressed or milled into the stiffeners or into the circumference of the tubes, for positive transfer of vertical loads. The connections of the stiffeners to the posts are also configured in a transverse frictionally engaging manner to handle vertical loads.

The fastening means 13 are configured so that they can be used, without modification, on both the outer tube 2 and the inner tube 1, and constitute an attachment between a latticelike stiffener and the post that handles the forces which occur. The stiffener 8 greatly increases the load-bearing capacity of a scaffold. A suitable latticelike stiffener can result, for example, in a load-bearing capacity of more than 60 kN, even if the individual posts have a load-bearing capacity of 30 kN when extended.

In embodiments of the invention, the lobes 3 and 6 do not run over the entire length of the tube, but only over certain lengthwise segments of the tubes 1 and 2.

In the manufacture of a support scaffold, a plurality of post constructions, each consisting of an extensible post and a stiffener, can be arranged one above another, resulting in scaffold heights that are a multiple of the height of an extensible post. The post depicted can also be used as an individual post to accept any kind of ceiling loads.

The threads 5 arranged on the inner tube 1 to adjust the height of the post can either be cut into the outer surface of the lobes 3 in a metal-cutting manner, or rolled in, for example as the profiled sections are being manufactured (preferably by extrusion). With an outer tube length of 1.90 m, the individual parts have a weight that is, for example, less than 20 kg, although for reasons which include its particularly favorable cross-sectional shape, a post configured in this manner has a load-bearing capacity of 30 kN even if it is made of aluminum or an aluminum alloy.

The cross-sectional shapes of the outer tube 2 and the inner tube 1 can also have projections, running lengthwise along their inner surface, that provide further stiffening of the tube. The threads 5 can have either single or multiple threads.

A plurality of outer tubes can also be placed one above another, with only the topmost post having an inner tube with which the overall height of the scaffold is adjusted.

The inner tube of the post can also contain a further inner tube.

I claim:

1. Support scaffold with adjustable-height posts having an outer tube and an inner tube, and with stiffeners arranged between said outer and inner tubes for the attachment between said stiffener and at least one of said inner tube and said outer tube, wherein said stiffener can be fastened both to said outer tube and to said inner tube, said inner tube having a connecting element and said outer tube having a connecting element, and a connecting part of said stiffener is adapted for fastening onto both said inner connecting element and said outer connecting element, wherein the cross-sectional shape of the outer tube approximately corresponds to the cross-sectional shape of the inner tube and said connecting elements provided on the outer tube and inner tube have radially projecting lobes, respectively, for fastening the stiffener, wherein the lobes have a radius and projections, respectively, running perpendicular to said radius and, radially inward from said projections, recesses, for the entry of fastening means, engaging behind the projections, that are arranged on the stiffeners.

2. Scaffold according to claim 1, wherein the lobes and projections of the tubes are formed by the shape of the tube cross section.

3. Scaffold according to claim 1, wherein the lobes and projections extend over the entire length of the tubes.

4. Scaffold according to claim 3, wherein the inner tube has radially spaced lobes on whose circumferential surface external threads are provided.

5. Scaffold according to claim 1, wherein the post has T-shaped grooves running lengthwise, for the engagement of fastening means of stiffeners.

6. Scaffold according to claim 1, wherein fastening means engage onto the posts outside a plane defined by the axes of two tubes adjacent to one another.

7. Scaffold according to claim 1, wherein the posts are extendable.

8. Scaffold according to claim 7, wherein a scale is provided along the outer surface of the inner tube of the posts.

9. Support scaffold with adjustable-height posts having an outer tube and an inner tube, and with stiffeners arranged between said outer and inner tubes for the attachment between said stiffener and at least one of said inner tube and said outer tube, wherein said stiffener can be fastened both to said outer tube and to said inner tube, said inner tube having a connecting element and said outer tube having a connecting element, and a connecting part of said stiffener is adapted for fastening onto both said inner connecting element and said outer connecting element, wherein the cross-sectional shape of the outer tube approximately corresponds to the cross-sectional shape of the inner tube and said connecting elements provided on the outer tube and inner tube have radially projecting lobes, respectively, for fastening the stiffener, wherein the lobes have a radius and projections, respectively, running perpendicular to said radius and, radially inward from said projections, recesses, for the entry of fastening means, engaging behind the projections, that are arranged on the stiffeners, the lobes and projections of the tubes being formed by the shape of the tube cross-section and extending over the entire length of the tubes.

10. Scaffold according to claim 9, wherein the inner tube has radially spaced lobes on whose circumferential surface external threads are provided.

11. Scaffold according to claim 9, wherein fastening means engage onto the posts outside a plane defined by the axes of two tubes adjacent to one another.

12. Scaffold according to claim 9, wherein the posts are extendable.

13. Scaffold according to claim 12, wherein a scale is provided along the outer surface of the inner tube of the posts.

14. Support scaffold with adjustable-height posts having an outer tube and an inner tube, and with stiffeners arranged between said outer and inner tubes for the attachment between said stiffener and at least one of said inner tube and said outer tube, wherein said stiffener can be fastened both to said outer tube and to said inner tube, said inner tube having a connecting element and said outer tube having a connecting element, and a connecting part of said stiffener is adapted for fastening onto both said inner connecting element and said outer connecting element, wherein the cross-sectional shape of the outer tube approximately corresponds to the cross-sectional shape of the inner tube and said connecting elements provided on the outer tube and inner tube have radially projecting lobes, respectively, for fastening the stiffener, wherein the lobes have a radius and projections, respectively, running perpendicular to said radius and, radially inward from said projections, recesses, for the entry of fastening means, engaging behind the projections, that are arranged on the stiffeners, the lobes and projections of the tubes being formed by the shape of the tube cross-section and extending over the entire length of the tubes, wherein the inner tube has radially spaced lobes on whose circumferential surface external threads are provided, the posts are extendable, and a scale is provided along the outer surface of the inner tube of the posts.

* * * * *